United States Patent [19]

Lohest et al.

[11] 4,069,985

[45] Jan. 24, 1978

[54] WINDING MACHINES WITH CONTACT ROLLER DRIVEN BY SYNCHRONOUS MOTOR OR ASYNCHRONOUS MOTOR

[75] Inventors: Hans Lohest; Erich Lenk; Peter Illg, all of Remscheid, Germany

[73] Assignee: Barmag Barmer Maschinenfabrik Aktiengesellschaft, Remscheid-Lennep, Germany

[21] Appl. No.: 712,330

[22] Filed: Aug. 6, 1976

[30] Foreign Application Priority Data

| | | |
|---|---|---|
| Aug. 8, 1975 | Germany | 2535457 |
| Feb. 16, 1976 | Germany | 2606093 |

[51] Int. Cl.[2] ..... B65H 59/38

[52] U.S. Cl. ..... 242/45; 242/18 DD

[58] Field of Search ..... 242/45, 18 DD, 18 R

[56] References Cited

U.S. PATENT DOCUMENTS

| | | | |
|---|---|---|---|
| 2,950,067 | 8/1960 | Keith | 242/45 X |
| 3,288,383 | 11/1966 | Muller | 242/45 |

FOREIGN PATENT DOCUMENTS

| | | | |
|---|---|---|---|
| 1,195,598 | 5/1959 | France | 242/45 |
| 86,672 | 12/1971 | Germany | 242/45 |
| 926,567 | 5/1963 | United Kingdom | 242/45 |
| 944,552 | 12/1963 | United Kingdom | 242/45 |

*Primary Examiner*—Stanley N. Gilreath

*Attorney, Agent, or Firm*—Keil, Thompson & Shurtleff

[57] ABSTRACT

A filament winding machine having a winding spindle driven by an rpm-controllable electric drive motor, a contact roller in frictional contact with the rotating winding being formed and driven by a synchronous or an asynchronous, 3-phase electric motor and an electric control circuit responsive to deviations in the measured effective power absorption of the latter motor for maintaining a constant linear take-up velocity of the filaments onto the winding.

19 Claims, 4 Drawing Figures

WINDING MACHINES WITH CONTACT ROLLER DRIVEN BY SYNCHRONOUS MOTOR OR ASYNCHRONOUS MOTOR

INTRODUCTION

A known winding machine for winding synthetic polymer filaments running at a constant speed has a winding spindle with an rpm-controllable axial drive motor and a speed (rpm). control arrangement, as well as a contact roller which is in circumferential contact with the forming winding and whose drive torque maintained approximately constant during the winding process (German Pat. No. 1,267,780).

According to another known proposal, the control of the rpm-controllable axial drive motor of the winding spindle is provided by an arrangement wherein the contact roller is driven by a synchronous motor of the external rotor type. From a synchronous generator feeding the synchronous motor, there is prescribed a circumferential speed corresponding to the desired winding speed. Its stator shaft is rotatable, so that on occurrence of a transfer moment between the surface of the thread winding bobbin and the contact roller, the resulting rotary deflection of the stator provides the rpm control for the winding motor (German Published Application No. 1,246,864 and German Published Application 1,286,619). In this regulating arrangement, in which the winding circumferential speed is the regulating magnitude, it is not possible to detect the slippage between contact roller and winding or to maintain it constant. For this reason the mechanical measurement of the surface speed by detection of the deflection of the stator of the contact roller is always affected with a certain undependability and unevenness. This leads in the spinning of synthetic polymer filaments, and especially in godetless spinning, to instances of damage. Furthermore, this mechanical regulating system is expensive and subject to breakdown, and requires expensive readjustments upon change of the winding speed.

THE INVENTION

The present invention has the problem of avoiding these disadvantages. In particular, there is provided a regulating system for the axial drive motor of the winding spindle which utilizes a central desired-value control for all the winding machines used with synthetic filament spinning installation. The crux of the invention resides in the combination of a winding spindle driven by an rpm-controllable axial drive motor; a contact roller in frictional contact with the forming winding and driven by a synchronous motor at a constant circumferential speed, and control means through which said axial drive motor has its rate of revolution (rpm) controlled in dependence on the measured effective power absorption of the synchronous motor.

An especially reliable, economical and technically simple form of execution is provided by control means embodying a Hall generator for measuring the effective power absorption, whose control circuit connections are connected to a feed line of the synchronous motor, and whose control field terminals are connected to a voltage source which has the same frequency as the feed line of the synchronous motor, and whose Hall generator voltage outputs are connected with the rpm control arrangement with interposition of a desired valve control setting means and an amplification circuit.

Another aspect of the invention uses as the drive motor for the contact roller 3-phase asychronous motor instead of the aforesaid synchronous motor. Here also, there is provided a regulating system for the axial drive motor of the winding spindle which utilizes a central desired-valve control for all the winding machines used with synthetic filament spinning installation. The crux of the invention resides in the combination of a winding spindle driven by an rpm-controllable axial drive motor; a contact roller in frictional contact with the forming winding and driven by an asynchronous, 3-phase electric motor operable at a constant, prescribed, desired effective power, and electric circuit control means operatively connecting said motors and regulating, via rate of rotation control of said axial drive motor, the asychronous motor (up to negligible deviations of said desired effective power) in dependence on the measured effective power absorption of said asynchronous motor when said contact roller is rotating in frictional contact with said surface of said winding.

As especially reliable, economical and technically simple form of execution is provided by control means embodying a Hall generator for measuring said effective power. The Hall generator has its control current connections in a power feed line for the asynchronous motor and further has its control field connections connected to a voltage source which has the same frequency as said power line for the asychronous motor. The Hall voltage outputs are connected with the rate of rotation control (e.g., a frequency transformer) for the axial drive motor via circuit means including an amplification circuit. The control means further embodies electrical means for adjustably setting the desired value of its output signals, the latter and its electrical means being operatively associated with the output signals of said Hall generator.

The third aspect of the invention uses as a drive motor for the contact roller a three-phase electrical motor (synchronous or asynchronous). Here also, there is provided a regulating system for the axial drive motor of the winding spindle, which utilizes a central desired value control for all the winding machines used with synthetic filament spinning installation. The crux of the invention resides in the combination of a winding spindle driven by an rpm-controllable axial drive motor; a contact roller in frictional contact with the forming winding and driven by an asynchronous or synchronous three-phase electrical motor operable at a constant, prescribed, desired current, and electric circuit control means operatively connecting said motors and regulating, via rate of rotation control of said axial drive motor, the three-phase electrical motor (up to negligible deviations) in dependence of the measured current in one of the power supply lines of said motor, when said contact roller is rotating in frictional contact with said surface of said winding.

The control means further embodies electrical means for adjustably setting the desired value of said current in order to ensure that any alteration of the current (dI) and the thereby caused alteration of the engine torque (dM) of the three-phase electrical motor have the same direction, i.e.:

$$dI/dM \geqq 0.$$

The invention herein has the advantage that no mechanical measuring arrangements are used and that the constant slippage and the short slippage fluctuations between contact roller and winding do not have any effect. Thereby, the rate of rotation (rpm) of the axial drive motor of the winding spindle is reduced uniformly with the growing diameter of the winding. The desired value of winding take up linear velocity can be set centrally on the machine. The desired value should be prescribed in such a way that the power is supplied about in equal proportions by the axial drive motor and the contact roller motor. Other relations, however, are also possible. In any case, it is assured that the contact roller power and also the contact roller torques either remain constant at equal constant roller rotation rate or are varied according to a prescribed program during the bobbin winding. These avoid damages to the winding surface and make possible the highest winding speeds.

THE ILLUSTRATED EMBODIMENT

In the following the invention is described in the form of a preferred embodiment, which is illustrated in the drawings, wherein.

Figure 1:
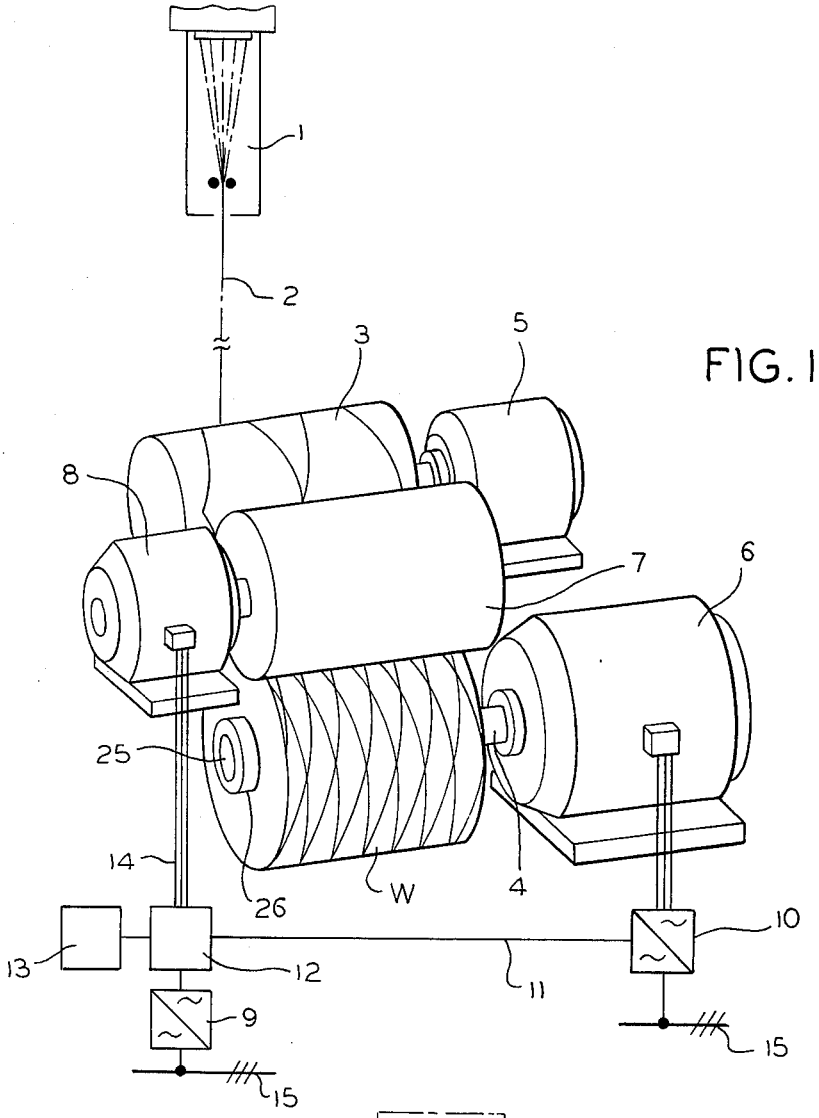
FIG. 1 is a perspective view of a winding machine.

In FIG. 1, the filaments 2 coming from the spinning installation 1 via the traverse roller 3 is wound into a winding W in the winding spindle 4. The spirally grooved traverse roller 3 is driven by motor 5 at a constant rate of rotation (rpm). The winding spindle 4 is driven by axial drive motor 6 with decreasing rate of rotation. Further, the winding W is in circumferential contact with the contact roller 7. The contact roller—as shown in FIG. 1—can extend over the entire length of the winding. It may be, however, one or more shorter cylinders or disks which extend in each case only over a part of the winding length and, in particular, touch only the edge zones of the winding surface, e.g., as in German Laid-open Applications OS No. 23 10 202. The contact roller 7 is driven at a constant rate of rotation by the synchronous motor 8. The axial drive motor 6 can be any rotational-rate-controllable motor, such as, for example, a direct-current motor, or—as herein—a frequency-controllable asynchronous motor which is connected to a controllable frequency transformer 10. The input 11 of the frequency transformer 10 is connected with the rate of rotation control arrangement 12 and the desired value setting means 13. The control arrangement 12 detects the effective power absorption of the synchronous motor 8 and is interposed in the feed line 14 of the synchronous motor 8 from the adjustable frequency transformer 9. The circuit of the control arrangement 12 is described in the following with the aid of FIG. 2.

The synchronous motor 8 of the contact roller 7 is—as stated—connected to the three-phase current main 15 via the adjustable frequency transformer 9. The effective power absorbed by the synchronous motor 8 is measured by a measuring device 16. This measuring device has control current connections 17 which are connected in a feed line of the synchronous motor as well as control voltage connections 18 which detect the phase voltage of the feed line of the synchronous motor 8 with consideration of the phase displacement between voltage and current. The measuring device 16 may be a measuring device according to the principle of pulse-duration and pulse amplitude modulaton (Time Division Multiplication). For details, reference is made, for example, to Telefunken-Zeitschrift, Sept. 1960, pp. 29 ff.

Advantageously, the measuring device 16, however, utilizes a Hall generator, the control current connections of which influence the magnetic field of the Hall generator. The feed line 19 of the synchronous motor and its control field connections 18 are placed on the same phase voltage as that of the synchronous motor 8.. The control field connections 18 of the synchronous motor 8 are connected to a voltage source, the resistor 20, which has the same frequency as that of the feed line 19 for the motor 8. The outputs 21 of the measuring device or Hall generator 16 are impressed, with interposition of a current limiter 23, on a regulating circuit means 22, known per se, in which the output signal of the measuring device or of the Hall generator 16 is first compared with the output signal of an adjustable desired-value setting means 13. The outputs of the regulating circuit 22 act on the frequency transformer 10, which in dependence on the output signal of the measuring device or Hall generator, controls the fed-in secondary frequency to the asynchronous motor 6, which serves as axial drive motor of the bobbin spindle 4.

Through the detection of the effective power absorption of the synchronous motor for the purpose of regulating the rate of rotation of the axial drive motor, it becomes possible to maintain constant the surface speed of the winding W, as well as the effective power absorption of the synchronous motor. If the synchronous motor 8 of the contact roller drive is more strongly burdened than prescribed by the desired-value setting means 13, then through the measuring device or the Hall generator 16 a corresponding output signal is passed via the regulating circuit 22 with the amplifiers P1 and P2 as voltage to the frequency transformer 10. The latter sends onward its secondary frequency proportional to voltage or in a voltage/frequency (V/Hz) ratio adapted to the winding process and correspondingly adapted and correspondingly programmed to the axial drive motor 6. Thereby, the imposed changes upon rates of rotation of the asynchronous motor 6 and the synchronous motor 8 are again relieved, so that the regulating circuit becomes inactive. The regulating process in the case of reduced power absorption of the synchronous motor 8 is the reverse of the just-described process.

The effective power absorption of the synchronous motor 8 can be adjusted by desired value setting means 13 positively, negatively or also on zero as its desired value, so that the synchronous motor drives or brakes or else runs at the same peripheral speed as the winding's peripheral speed. Likewise the effective power absorption can be varied in the course of the winding for a program adapted to the winding process, e.g., by a cam member which is operatively associated with the desired value setting means 13 to vary the value setting as the diameter of the winding increases.

In a synthetic polymer spinning installation with a plurality of pirning heads, each winding station has a measuring device or a Hall generator 16, a regulating circuit 22 and a frequency transformer 10. The frequency transformer 9 for the supplying of the snychronous motor 8 as well as the desired-value setting device 13 for the power absorption of the synchronous motor 8 can, however, be located centrally in the spinning installation and can be used in common for a plurality of pirning heads.

Figure 2:
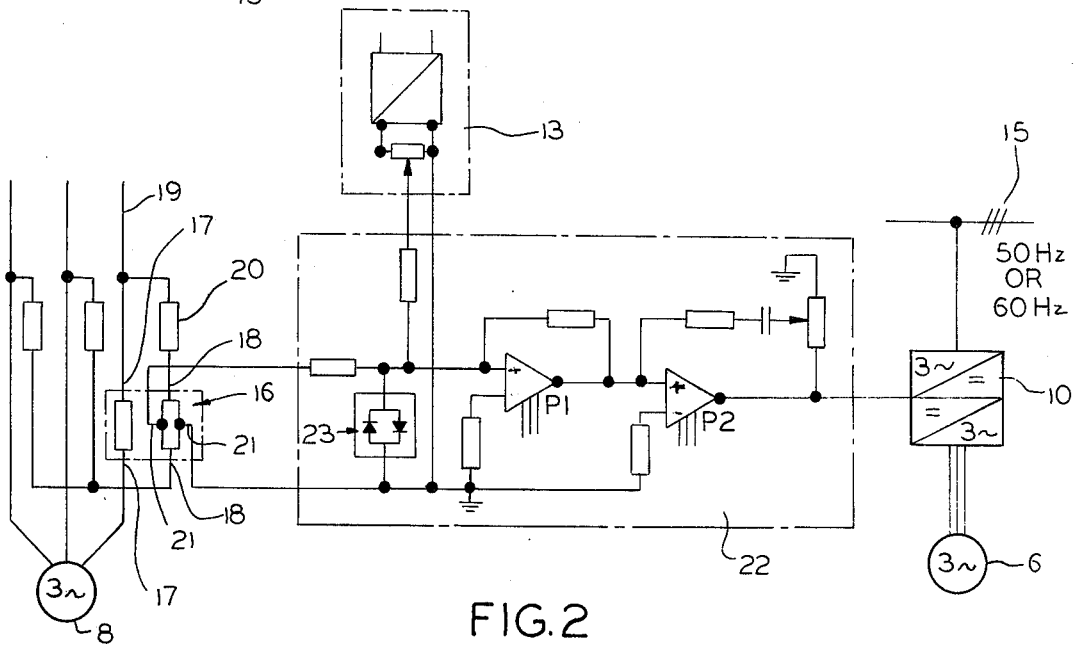
FIG. 2 is the circuit diagram of the drive of the winding machine, insofar as is essential to the invention.

The components of circuitry illustrated in FIG. 2 are well known in the art. Those parts not identified by reference numerals and/or letters in FIG. 2 include resistors (rectangular boxes) and the common symbols for capacitors, ground, and a variable tap resistor in the desired value setting means 13.

Alternate Embodiment

The winding machine of the foregoing embodiment has proved extremely successful, since it permits very high winding speeds. Its only disadvantage is the use of the synchronous motor, since synchronous motors are expensive and absorb high starting currents. This alternate embodiment, while retaining the basic concepts of our invention and its advantages, provides a winding machine with economical and sturdy drive motors. This embodiment is characterized by (a) the three-phase current motor for the contact roller is an asynchronous motor which is driven at constant, prescribed, desired effective power, the actual effective power absorption of which is measured; (b) via rate of rotation control of the axial drive motor of the winding spindle the asynchronous motor is regulated up to negligible deviations from the desired effective power; (c) the desired frequency of the asynchronous motor of the contact roller is fed with account taken of the slippage to be expected at the prescribed effective power; and (d) a Hall generator may be utilized for the measurement of the effective power.

The foregoing concepts contravene the generally existing prejudice that it is possible to achieve constant circumferential velocities, such as are necessary in winding technology, solely through synchronous machines. This embodiment also makes possible the use of an asynchronous motor to attain the above objectives and advantages.

A preferred form of this alternate embodiment is described below, also with reference to FIGS. 1 and 2 of the drawing, wherein the description of the first embodiment applies to the alternate embodiment with the exceptions noted hereafter.

In contrast to the first embodiment, the contact roller 7 is driven not by a synchronous motor, but by the asynchronous motor 8. The traverse roller 3 is driven by the motor 5 at a constant speed or at a wobbled speed (for the purpose of mirror disturbance). The winding spindle 4 is driven by axial drive motor 6 with decreasing turning rate of rotation.

The contact roller, unlike the first embodiment, is driven at a constant rotational rate by the asynchronous motor 8. The rate of rotation control arrangement 12 detects the effective power absorption of the asynchronous motor 8 and is, therefore, interposed in the feed line 14 of the asynchronous motor 8 from the adjustable frequency transformer 9. The circuit of the speed control arrangement 12 is described in the following with the aid of FIG. 2.

Similarly to the first embodiment, the asynchronous motor 8 of the contact roller 7 is connected to the three-phase current main 15 via the adjustable frequency transformer 9. The effective power absorbed by the asynchronous motor 8 is measured by a measuring device 16. This measuring device has at its disposal control current connections 17 which are connected in a current feed line of the asynchronous motor as well as control voltage connections 18 which detect a phase voltage of the feed line of the asynchronous motor with consideration of the phase displacement between voltage and current. The aforesaid measuring device according to the principle of the pulse duration-and pulse amplitude modulation (Time Division Multiplication) may be used.

Advantageously, measuring device 16, however, embodies a Hall generator, the control current connections of which influence the magnetic field of the Hall generator and are placed in the feed line of the asynchronous motor. The Hall generator's control field connections are placed on the same phase voltage of the asynchronous motor 8. The outputs 21 of the measuring device or Hall generator 16 are impressed, with interposition of a current limiter 23, on a regulating circuit 22, known per se, in which the output signal of the measuring device or Hall generator 16 is previously compared with the output signal of an adjustable desired-value setting means 13. The outputs of the regulating circuit 22 act on the frequency transformer 10, which in dependence on the output signal of the measuring device or Hall generator, controls the fed-in secondary frequency to the asynchronous motor 6, the axial drive motor of the bobbin 4.

Through the detection of the effective power absorption of the asynchronous motor of the contact roller 7 for the purpose of regulating the rotational rate of the axial drive motor, it becomes possible to maintain constant surface speed of the winding W as well as the effective power absorption of the asynchronous motor 8. If the asynchronous motor 8 of the contact roller drive is more strongly burdened than prescribed by the desired-value setting means 13, then through the measuring device or Hall generator 16 a corresponding output signal is passed via the regulating circuit 22 with the amplifiers P1 and P2 as voltage to the frequency transformer 10. The latter sends onward its secondary frequency voltage, proportionally or in a programmed voltage/frequency ratio (V/Hz) adapted to the winding process and correspondingly programmed to the axial drive motor 6. Thereby, the imposed changes upon the rates of rotation of the asychronous motor 6 and the asynchronous motor 8 of the contact roller 7 are again relieved, so that the regulating circuit becomes inactive. The regulating process in the case of reduced power absorption of the asynchronous motor 8 is the reverse of the above-described process. The effective power absorption of the asynchronous motor 8 of the contact roller 7 can be set by the desired-value setting means 13 in its desired value positively, negatively or on zero, so that the asynchronous motor 8 in part drives the contact roller 7, or brakes it, or else it runs precisely with a nominal rotational rate corresponding to a prescribed surface peripheral speed for the contact roller 7. Likewise the effective power absorption can be varied in the course of the bobbin journey according to a program as described above for the first embodiment.

As aforestated with regard to a spinning installation with a plurality of pirning heads, each winding station has a measuring device or a Hall generator 16, a regulation circuit 22 and a frequency transformer 10. The frequency transformer 9 for the asynchronous motor 8 as well as the desired-value setting means 13 for the power absorption of the asychronous motor 8 can, however, be located centrally in the spinning installation and can be used in common for a plurality of pirning heads.

The rate of rotation of the asynchronous motor 8 is prescribed by the adjustable frequency transformer 9. However, there is also taken into account a slippage of the asynchronous motor. This slippage is constant, since also the effective power absorption of the asynchronous motor 8 is maintained constant by the regulation provided by the desired-value setting means 13. The frequency to be supplied by means of frequency transformer 9 is set in such a way that the nominal rate of rotation of the asynchronous motor 8 is greater by the amount of the slippage which occurs at the prescribed effective power absorption.

THE PROCESS

This aspect of the invention involves processes for the winding of filaments on winding bobbins at constant, predetermined, peripheral speed of the winding being formed by driving and controlling the rate of rotation of respective drive spindles or shafts 4, each having a chuck 25 on which are mounted a winding bobbin or tube 26 and the winding W formed thereon. The process steps comprise:

a. rotatably driving the spindle and its chuck by an electric drive motor 6, b. controlling the rotational speed of said drive motor, c. contacting the peripheral surface of the winding W being formed by a rotatable contact roller 7, d. driving said contact roller by a three-phase alternating current electric motor 8, preferably an asynchronous three-phase motor connected to an adjustable transformer 9, e. adjusting the frequency of said frequency transformer and thereby adjusting the peripheral speed of the contact roller 7, when said contact roller is without load, to a peripheral speed equal or not more than 20% higher than a predetermined constant peripheral speed for the winding, f. measuring the current in one phase 19 of said alternating current motor and producing of measuring signal, e.g., by the component 16, g. producing of a controllable constant signal, respresenting the wattage, by which the contact roller is acting on the winding, by adjusting a controllable signal producing means 13, h. comparing said measuring signal from component 16, representing the current in said one phase, and said constant signal from means 13 and producing a difference signal, representing the difference between both signals, i. feeding said difference signal into an electric control means 22,10 connected to said drive motor 6 for said spindle and its chuck, j. and thereby controlling the rotational speed of said drive motor 6 when said difference signal exceeds a predetermined constant value in a sense of changing the rotational speed of said drive motor to return said difference signal to its predetermined constant value.

Preferably, the measurement of current per step (f) also includes measuring the voltage having the same frequency as the measured current in one phase of said alternating current motor, as well as multiplying the measured current and the measured voltage and thereby producing a signal representing the wattage input to said alternating current motor.

The winding machines and winding processes described above provide reliable winding machines and techniques wherein take-up of filaments, yarns or like articles of synthetic polymers onto windings can be achieved at high, constant, linear velocities of the filaments to which the peripheral velocities of the windings are attuned. While especially useful in spinning installation of the type herein described, the winding machines and processes are useful in other winding applications.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

Figure 3:
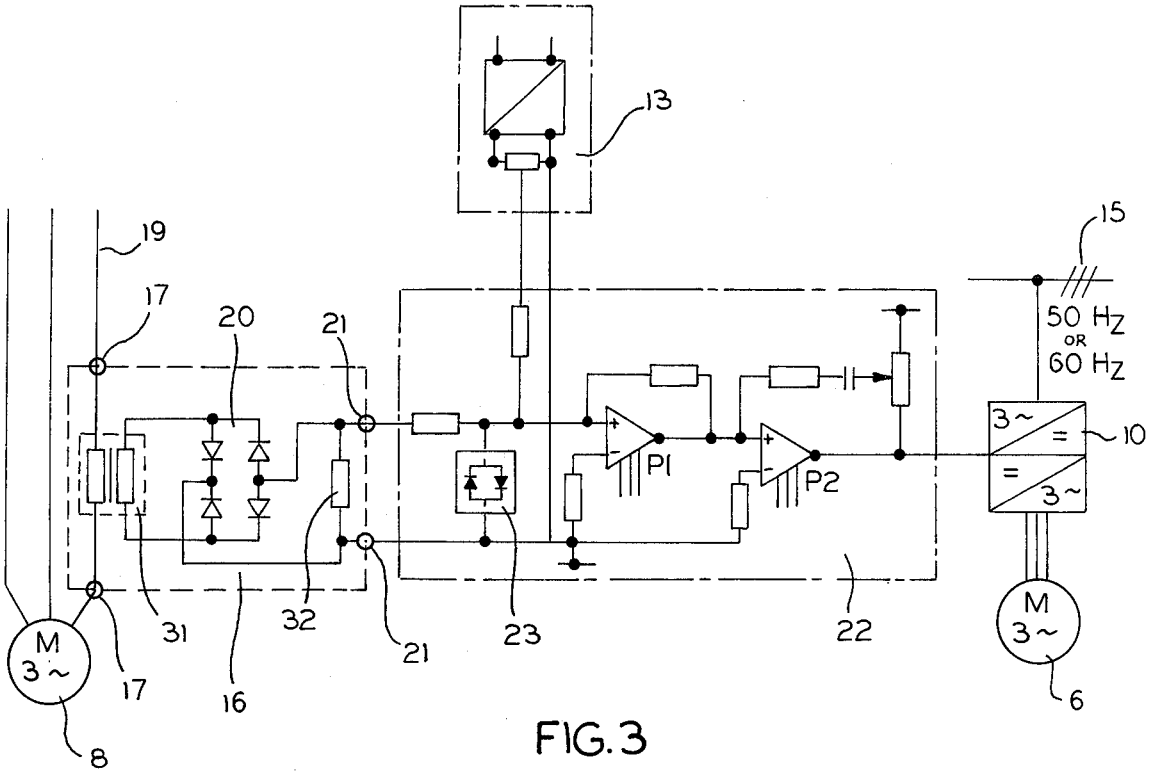
FIG. 3 is another embodiment of a circuit diagram of the drive of the winding machine, insofar as is essential to the invention.
Figure 4:
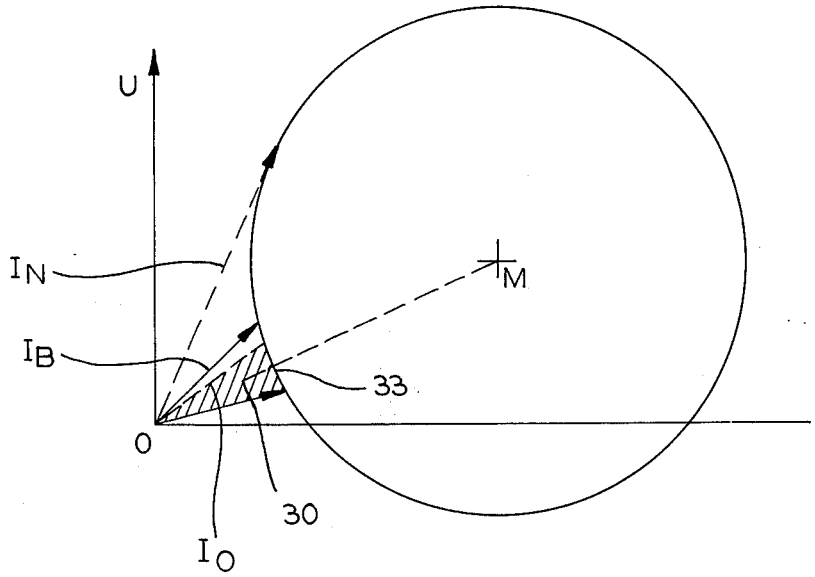
FIG. 4 is the HEYLAND-circle for an asynchronous motor.

Description of FIG. 3 and FIG. 4.

FIG. 3 and FIG. 4 are serving the purpose of making another aspect of the invention more clear, for which, however, all statements as made for FIG. 1 are valid, too.

As per FIG. 3, the three-phase electrical motor can either be a synchronous or asynchronous motor. In phase 19 of motor 8 the connections for the measuring means 16 are included. The measuring means 16 consists of a transformer 31. The primary coil of the transformer is enclosed in the current supply line 19. The secondary coil is enclosed in the circuit, comprising rectifier 20 and a resistor 32. The rectifier consists of diodes.

At the exists 21 of the measuring means 16 appears a voltage drop of the resistor 32. The voltage drop represents a current, flowing in current supply line 19. This voltage drop is fed into the regulating circuit means 22, with the voltage limiter 23. Another voltage input of regulating circuit means 22 stems from adjustable desired-value setting means 13, by which a desired voltage can be adjusted and supplied to the circuit means 22. The voltage steming from resistor 32 is compensated by the adjusted voltage, steming from setting means 13 so that only the difference of both voltage signals is fed to amplifiers P1 and P2 and to the frequency transformer 10. The latter works as it is described with relation to FIG. 1 and FIG. 2, in order to adjust the rotational speed of motor 6 (in this case another three-phase asynchronous electrical motor) to difference signal formed by the regulating circuit means 22.

When using this aspect of the invention as it is described in connection with FIG. 3, the adjustable desired-value setting means 13 has to be carefully adjusted. The principles of this adjustment can be seen from FIG. 4, as described later on.

As well as with the other embodiments of the invention, the alternating current motor 8 of the contact roller 7 is connected to the alternating current circuit of the adjustable statical or rotary frequency converter 9 (see FIG. 1). By this, the amount of revolutions of the alternating current motor for the contact roller 7 can be determined in such a way that the contact roller is adjacent to the spool surface with constant peripheral speed, which is nearly the same as the speed of the filament. When using an asynchronous motor, its slippage is also respected. This slippage is constant, since the effective power and the current of the three-phase motor 8 is kept constant by means for desired-value setting means 13, regulating means 22 and measuring means 16. This, however, for an asynchronous motor is only true, if the engine torque of the asynchronous motor (as it is defined by the product from voltage, current, and power factor (cos $\phi$ ), by adjustment of desired-value setting means) is adjusted in such a way that alterations of the engine torque (dM) and alterations of the current (dI) have the same direction.

As it is shown in FIG. 4, the behaviour of the asynchronous motor can be described by a so-called HEYLAND-OSSANNA circle. This circle describes the top of the current vector for all loads of the asynchronous motor. "$I_O$" is the current within the asynchronous motor without load. "$I_N$" is the current at the nominal load, forming the tangent of the circle.

A current to be adjusted by the desired-value setting means 13 should lie between the non-desired region 30 and the vector of $I_N$, e.g., the vector $I_B$.

The undesired region 30 is characterised by the following facts:

As it can be seen from FIG. 4, the current, flowing with the motor unloaded is $I_O$. If the load (engine torque) is growing, the current at first becomes smaller, until it reaches the connection line between point O and point M. That means that the alteration of the torque is positive, whereas the alteration of the current is negative. That means that $dI/dM$ is negative, i.e. smaller than zero. From point 33 on, "I" is increasing. In all the region 30, the alterations of the current, however, are so small that they are nearly like zero, as it can easily be seen from FIG. 4. That means, however, that in region 30 also the quotient of the differences $dI/dM = 0$, which is less favorable.

The motor 8 with the current between the region 30 and the vector $I_N$ has — as it is described before — the first advantage that the peripheral speed of the asynchronous motor 8 can be kept constant only by measuring this current with a relatively simple and cheap regulating system. The other advantage is that the current, and therefore the engie torque is relatively low so that the contact roller is only effecting unconsiderable forces to the winding.

The invention is hereby claimed as follows:

1. A winding machine adapted for the winding of synthetic polymer filaments on a bobbin mounted on a winding spindle which comprises a winding spindle driven by a rate of rotation-controllable axial drive motor, a contact roller adapted to be in frictional contact with the surface of the forming winding, said roller being driven by a synchronous electric motor at a constant circumferential speed, and electric circuit conrtol means operatively connecting said motors and regulating the rate of rotation of said axial drive motor in dependence on the measured effective power absorption of said synchronous motor when said contact roller is rotating in frictional contact with said surface of said winding.

2. A winding machine according to claim 1, said control means being characterized by a Hall generator for measuring said effective power absorption, said Hall generator having its control current connections in a power feed line for said synchronous motor, and further having its control field connections connected to a voltage source which has the same frequency as said power line for said synchronous motor, and the Hall voltage outputs being connected with the rate of ratation control means for said axial drive motor via circuit means including an amplification circuit, and means for adjustably setting the desired value of its output signals and operatively associated with the output signals of said Hall generator.

3. A winding machine adapted for the winding of synthetic polymer filaments on a bobbin mounted on a winding spindle which comprises a winding spindle driven by a rate of rotation-controllable axial drive motor, a contact roller adapted to be in frictional contact with the surface of the forming winding, said roller being driven by an asynchronous, 3-phase electric motor operable at a constant, prescribed, desired effective power, and electric circuit control means operatively connecting said motors and regulating, via rate of rotation control of said axial drive motor, the asynchronous motor up to negligible deviations of said desired effective power, in dependence on the measured effective power absorption of said asynchronous motor when said contact roller is rotating in frictional contact with said surface of said winding.

4. A winding machine according to claim 3, said control means being characterized by a Hall generator for measuring said effective power, said Hall generator having its control current connections in a power feed line for said asynchronous motor, and further having its control field connections to a voltage source which has the same frequency as said power line for said asynchronous motor, and the Hall voltage outputs being connected with the rate of rotation control means for said axial drive motor via circuit means including an amplification circuit, and means for adjustably setting the desired value of its output signals and operatively associated with the output signals of said Hall generator.

5. A winding machine as claimed in claim 3, and means to supply 3-phase power to said asynchronous motor to provide said constant, prescribed, desired effective power with compensation for the expected slippage of said asnychronous motor driven at its said constant, prescribed, desired effective power.

6. A winding machine adapted for the winding of synthetic power filaments on a bobbin mounted on a winding spindle which comprises a winding spindle driven by a rate of rotation-controllable axial drive motor, a contact roller adapted to be in frictional contact with the surface of the forming winding, said roller being driven by a 3-phase electric motor at a constant circumferential speed, an adjustable frequency transformer connected with the 3-phase motor, means for measuring the current in a power line of the three-phase current motor and giving a responsive measuring signal, an adjustable desired-value setting means which generates an adjusted, constant desired signal, and means for comparing the prescribed constant desired signal with the measuring signal, means for the generation and amplification of the difference signal, and further means for controlling the rate of rotation of the axial drive motor whereby its rate of rotation is altered when the difference signal exceeds a prescribed value.

7. A winding machine according to claim 6, said means for measuring the current being characterised by a Hall-generator, said Hall-generator having its control current connections in a power feed line for said three-phase motor, and further having its control field connections connected to a voltage source which has the same frequency as said power line for said three-phase motor, and the Hall voltage outputs being connected with the rate of rotation control means for said axial drive motor via circuit means including an amplification circuit, and means for adjustably setting the desired value of its output signals and operatively associated with the output signals of said Hall-generator.

8. A winding machine according to claim 6, wherein said three-phase motor is an asynchronous three-phase motor.

9. A process for the winding of filaments on winding bobbins at constant, predetermined, peripheral speed of the winding being formed by driving and controlling the rate of rotation of a drive spindle and its chuck on which are mounted a winding bobbin and the winding formed thereof by:

a. rotatably driving the spindle and its chuck by an electric drive motor,
b. controlling the rotational speed of said drive motor,
c. contacting the peripheral surface of the winding being formed by a rotatable contact roller,
d. driving said contact roller by a three-phase alternating current electric motor connected to a frequency transformer,
e. adjusting the frequency of said frequency transformer and thereby adjusting the peripheral speed of the contact roller, when said contact roller is without load, to the speed or slightly higher than the predetermined constant peripheral speed of the winding,
f. measuring the current in one phase of said alternating current motor and producing a measuring signal,
g. producing a controllable constant signal, representing the wattage, by which the contact roller is acting on the winding, by adjusting a controllable signal producing means,
h. comparing said measuring signal, representing the current in said one phase, and said constant signal and producing a difference signal, representing the difference between both signals,
i. feeding said difference signal into a control means connected to said drive motor for said spindle and its chuck,
j. and thereby controlling the rotational speed of said drive motor when said difference signal exceeds a predetermined constant value in a sense of changing the rotational speed of said drive motor to return said difference signal to its predetermined constant value.

10. A process as claimed in claim 9, and measuring in step (f) the voltage having the same frequency as the measured current in one phase of said alternating current motor, as well as multiplying the measured current and the measured voltage and thereby producing a signal representing the wattage input to said alternating current motor.

11. A process as claimed in claim 10, wherein the alternating current motor is an asynchronous motor.

12. A process as claimed in claim 9, wherein the alternating current motor is an asynchronous motor.

13. A winding machine according to claim 1, said synchronous motor being connected to a three-phase power supply and a manually adjustable frequency generator for providing said constant circumferential speed.

14. A winding machine according to claim 1, said electrical circuit control means comprising further means for adjustably setting the desired value of the effective power consumption as well as means for comparing the measured power consumption with said desired value and forming the difference signal, and for feeding said difference signal to a rate of rotation control means connected to said axial drive motor.

15. A winding machine as claimed in claim 3, said electric circuit control means comprising means for adjustably setting the desired value of the effective power consumption as well as means for comparing the measured power consumption with said desired value and forming the difference signal, and for feeding said difference signal to a rate of rotation control-means, connected to said axial drive motor.

16. A winding machine according to claim 6, said means for measuring the current, comprising a transformer, the primary coil of which being enclosed in a power feed line for said three-phase motor and the secondary coil being enclosed in a circuit with a resistor, the voltage drop on said resistor being said measuring signal.

17. A winding machine as claimed in claim 6 and means for adjusting said constant desired signal to a value so that alterations of the current in said power line will lead to an alteration of the torque, which has the same direction as the alteration of the current, so that the quotient of the differences is:

$$dI/dm \geqq 0.$$

18. A process as claimed in claim 9 and in a step g adjusting controllable signal producing means so that the current in said phase of said alternating current motor is so high that alterations of said current lead to an alteration of the torque of the three-phase alternating current electric motor, which has the same direction as the alteration of the current, so that the quotient of the differences is:

$$dI/dm \geqq 0.$$

19. A winding machine as claimed in claim 3 and three-phase power supply means for said asynchronous motor and having a manually adjustable frequency transformer for providing said constant, prescribed, desired effective power with compensation for the expected slippage of said asynchronous motor when driven at its constant, prescribed, effective power.

* * * * *

UNITED STATES PATENT AND TRADEMARK OFFICE

CERTIFICATE OF CORRECTION

PATENT NO. : 4,069,985

DATED : January 24, 1978

INVENTOR(S) : Hans Lohest, Erich Lenk and Peter Illg

It is certified that error appears in the above-identified patent and that said Letters Patent are hereby corrected as shown below:

Column 9, line 63, "ratation" should read --rotation--.

Column 10, line 34, "asnychronous" should read --asynchronous--;
line 37, "power" should read --polymer--.

Column 11, line 9, "thereof" should read --thereon--;

Column 12, line 36, "dI/dm $\geqq$ 0." should read --$\frac{dI}{dM} \geqq 0$.--;
line 46, "dI/dm $\geqq$ 0." should read --$\frac{dI}{dM} \gtrless 0$.--.

Signed and Sealed this

First Day of August 1978

[SEAL]

Attest:

RUTH C. MASON
*Attesting Officer*

DONALD W. BANNER
*Commissioner of Patents and Trademarks*